United States Patent [19]

Deckert

[11] 4,131,698

[45] Dec. 26, 1978

[54] PRETREATMENT OF POLYVINYL CHLORIDE PLASTICS FOR ELECTROLESS DEPOSITION

[75] Inventor: Cheryl A. Deckert, Lawrenceville, N.J.

[73] Assignee: RCA Corporation, New York, N.Y.

[21] Appl. No.: 861,453

[22] Filed: Dec. 16, 1977

[51] Int. Cl.[2] ..... C23C 3/02

[52] U.S. Cl. ..... 427/304; 156/668; 252/79.5; 427/57; 427/305; 427/306; 427/307; 427/299; 427/316

[58] Field of Search ..... 252/79.5; 156/668; 427/304;305;307;299;306;57;316

[56] References Cited

U.S. PATENT DOCUMENTS

| | | | |
|---|---|---|---|
| 3,361,589 | 1/1968 | Lindsey | 156/668 |
| 3,702,286 | 11/1972 | Ichiki et al. | 427/307 |
| 3,716,394 | 2/1973 | Waggoner | 427/306 |
| 3,770,528 | 11/1973 | Hermes | 156/668 |
| 3,791,848 | 2/1974 | De Angelo | 427/307 |
| 3,914,520 | 10/1975 | Hovey | 427/304 |
| 3,962,496 | 6/1976 | Leech | 427/306 |

FOREIGN PATENT DOCUMENTS

| | | | |
|---|---|---|---|
| 2199012 | 5/1974 | France | 252/79.5 |
| 1110765 | 4/1968 | United Kingdom | 427/304 |

OTHER PUBLICATIONS

Richter, Textbook of Organic Chemistry, John Wiley & Sons, c. 1943, p. 244.

*Primary Examiner*—John D. Smith
*Attorney, Agent, or Firm*—H. Christoffersen; Birgit E. Morris; A. Stephen Zavell

[57] ABSTRACT

A process for pretreating polyvinyl chloride plastics to form adherent non-grainy conformal metal coatings by electroless deposition comprising immersing the polyvinyl chloride plastic in a solution comprising at least about 10 grams of alkali metal hydroxide dissolved in a solution consisting of about 5% to about 30% by volume of a water-soluble mono-, di-, or polyhydric alcohol and about 70% to about 95% by volume of water. The immersion time is variable from about 5 minutes in ultrasonically agitated, mildly heated solutions to about 6 to about 8 hours in non-agitated, unheated solutions. After pretreatment, the polyvinyl chloride plastic is treated by standard electroless plating procedures known in the art.

9 Claims, No Drawings

PRETREATMENT OF POLYVINYL CHLORIDE PLASTICS FOR ELECTROLESS DEPOSITION

This invention relates to a process of pretreating polyvinyl chloride (PVC) plastics prior to electroless deposition of a metal layer thereon.

BACKGROUND OF THE INVENTION

Electroless deposition of a metal on plastics requires the preparation of the plastic surface to accept the electroless metal coating. Depending upon the type of plastic to be treated by electroless deposition, the prior art teaches numerous methods of surface treatment.

Electron sputtering or glow discharge surface treatments of polyvinyl chloride (PVC) plastics prior to electroless deposition improve the adherence of a subsequently deposited metal coating to the PVC substrate. However, these treatments require expensive vacuum equipment and are more labor intensive than a completely wet-chemical process.

Acid etchants such as phosphoric acids, sulfuric acid, chromic acid, and hydrochloric acid, roughen the surface of the plastic sufficiently to permit the deposition of adherent metal layers. However, the acid etchants tend to pit and degrade the surface of PVC plastic and are thus not suitable when a non-grainy conformal metal coating must be deposited.

High temperatures and high concentration of bases will also tend to etch or render PVC plastics porous. The porosity of the plastic presents many problems to workers skilled in the art desiring to apply a non-grainy conformal metal layer to the plastic by electroless deposition.

Thus, a chemical process which can pretreat a PVC plastic, without etching or degradation, to accept an adherent, non-grainy conformal metal layer by electroless deposition would be highly desirable.

SUMMARY OF THE INVENTION

I have found that adherent, non-grainy conformal metal layers can be applied to PVC plastic substrates by pretreating the substrate surface before electroless deposition. The present process comprises the immersion of the PVC plastic in a solution comprising an alkali metal hydroxide, water and a mono-, di-, or polyhydric water-soluble alcohol or mixtures of alcohols. After immersion into the pretreatment solution, the PVC plastic is processed in accordance with electroless deposition methods known in the art. The pretreated plastic yields a final metallized plastic with a non-grainy conformal adherent metal layer attached thereto.

DETAILED DESCRIPTION OF THE INVENTION

The method according to my invention involves the immersion of PVC plastic such as a vinyl record, in an aqueous solution comprising at least about 10 grams per liter to about 400 grams per liter of an alkali metal hydroxide, such as LiOH, NaOH, and KOH; about 70% to about 95% by volume of water; and about 5% to about 30% by volume of a mono-, di-, or polyhydric water-soluble alcohol for a sufficient time to pretreat the surface of said plastic to enable subsequent electrolessly deposited metals to better adhere to the plastic and form non-grainy conformal coatings.

Although the exact reasons for the improved adherence of subsequently deposited metal layers is not wholly understood, it is presently believed that during immersion the alkali metal hydroxide removes hydrogen and chlorine atoms from the PVC plastic according to the following proposed reaction:

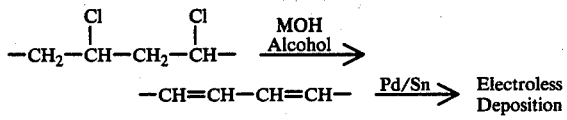

wherein M is any alkali metal.

The mono-, di-, or polyhydric alcohol useful herein may be any alcohol known in the art which is soluble in water. Suitable mono-, di-, or polyhydric alcohols include, but are not limited to, methanol, ethanol, isopropanol, 1,4-butanediol, ethylene glycol, propylene glycol, and glycerin. Due to their cost and availability, methanol and ethanol are preferred alcohols. The alcohol is present in a concentration from about 5% and preferably about 10% to about 30% by volume of the total solution. If the alcohol concentration in the solution is less than 5%, then the solution's ability to wet the plastic surface is decreased; alcohol concentrations of about 5% to about 10% cause the solution to marginally wet the plastic surface. The surface wetting helps the alkali metal hydroxide to react more readily with the plastic surface. When relatively higher concentrations of the alkali metal hydroxide are present, an alcohol concentration greater than about 25% by volume may cause the formation of a two phase solution. The alcohol concentration should be adjusted to avoid a two phase solution. Thus, 25% to 30% by volume alcohol is the highest acceptable concentration.

The water concentration varies from 70% to about 95% by volume of the total solution.

Heating the alcoholic hydroxide solution to a temperature from about 35 to 40° C. accelerates the pretreatment of the PVC plastic substrate. Temperatures higher than about 40° C. may, however, tend to soften and degrade the plastic substrate.

Ultrasonic agitation of the solution in which a polyvinyl chloride substrate is immersed will also shorten the treatment time. The combination of heating and ultrasonic agitation reduces treatment time from overnight or several hours to several minutes.

Treated PVC plastic substrates can be processed by electroless deposition methods known in the art such as U.S. Patent 3,914,520, British Patent 1,110,765, or the procedure described in Example 1. After electroless deposition, the metal layer is sufficiently adherent to pass the Scotch tape test. Cellophane type is cut long enough to curl. The curled section is attached to the metallized substrates and then ripped off. Alternatively, a section of tape is cut and pressed onto the metallized plastic substrate and pulled off. Coatings which have not adhered well to the plastic surface will be pulled off by the cellophane tape.

The invention will be further illustrated by the following Examples but it is to be understood that the invention is not meant to be limited to the details described therein.

EXAMPLE 1

A wedge of plastic was cut from a standard PVC plastic record containing about 13% to about 15% by weight polyvinyl acetate and immersed in an alcoholic hydroxide solution comprising 200 grams (3.6 molar) of potassium hydroxide, 250 mL of ethanol, and 750 mL of deionized water overnight.

After pretreatment, the plastic wedge was rinsed in water for about 5 minutes and immersed and ultrasonically agitated in Shipley 1160, a mild cleaner, (a product of the Shipley Company, Inc., Newton, Mass.), diluted 1:19 with water, for about 3 minutes. The wedge was rinsed in water for about 2 minutes and immersed in a solution of about 8 parts water and about 1 part Shipley 9F, a palladiumtin catalyst, (product of the Shipley Company, Inc.) for about 2 minutes. Following the Shipley 9F solution, the wedge was water rinsed for about 2 minutes and immersed in a solution of about 3 to about 4 parts water and about 1 part Shipley Accelerator 19 for about 1 minute and water rinsed for about 1 minute. Thereafter, the wedge was immersed in an electroless nickel bath comprising about 1 part solution A, wherein solution A comprises 50 grams $NiSO_4.6H_2O$, 100 grams $Na_4 P_2O_7.10H_2O$, and 15 milliliters concentrated $NH_4OH$; about 1 part solution B, wherein solution B comprises 3 grams per liter dimethylamine borane $(CH_3)_2$-$NBH_3$; and about 6 parts $H_2O$. Finally, the wedge is water rinsed for about 1 minute then rinsed with ispropanol for about 30 seconds and spun dry.

After drying, the metal layer was sufficiently adhered to the polyvinyl plastic to pass the Scotch tape test.

EXAMPLE 2

Similar procedures to Example 1 was used; however, the alcoholic hydroxide solution comprises 200 grams of KOH, 100 mLs of ethanol and 900 mLs of water. The metallized PVC plastic substrate passes the Scotch tape test.

EXAMPLE 3

A polyvinyl chloride record disc was immersed in a solution consisting of 400 grams of KOH, 200 milliliters (mL) of methanol and 800 mL of water at a temperature of about 35 to about 40° C. and subjected to ultrasonic agitation at a frequency of about 40 kilohertz for about 5 minutes. Following the pretreatment, the disc was subjected to further cleaning, sensitizing, and electroless deposition steps in accordance with Example 1. The pretreatment produces a nickel coating on the polyvinyl chloride disc which is sufficiently adherent to pass the Scotch tape test.

I claim:

1. A process for pretreating a polyvinyl chloride plastic prior to electroless metal deposition which comprises immersing the polyvinyl chloride plastic in a solution consisting of an alkali metal hydroxide in a concentration from about 10 grams to about 400 grams per liter of solution, wherein said solution comprises about 5% to about 30% by volume of a water soluble mono-, di-, or polyhydric alcohol and about 70% to about 95% by volume of water.

2. The process according to claim 1 wherein said alkali metal hydroxide is selected from the group consisting of lithium hydroxide, sodium hydroxide, and potassium hydroxide.

3. The process according to claim 1 wherein said mono-, di-, or polyhydric alcohol is selected from the group consisting of methanol, ethanol, 1,4-butanediol isopropanol, ethylene glycol, propylene glycol, and glycerin.

4. The process according to claim 1 wherein the pretreatment solution is agitated ultrasonically.

5. The process according to claim 4 wherein said pretreatment solution is heated to a temperature of about 35 to about 40° C.

6. The process according to claim 5 wherein the solution comprises about 200 grams of KOH per liter of solution, wherein said solution comprises about 20% by volume of methanol and about 80% by volume of water.

7. A process for pretreating a polyvinyl chloride plastic prior to electroless metal deposition comprising immersing said plastic into a solution comprising about 10 to about 400 grams of potassium hydroxide per liter of solution, wherein said solution comprises about 10% to about 25% by volume of an alcohol selected from the group consisting of methanol, ethanol, or mixtures thereof, and from about 75% to about 90% by volume of water.

8. The process according to claim 7 wherein from about 100 to about 400 grams of KOH per liter of solution are present.

9. In a process for the electroless deposition of metals on a polyvinyl chloride plastic comprising the steps of sequentially immersing the plastic in a catalyst solution, an acceleration solution and an electroless metal plating solution wherein the improvement comprises immersing said plastic in a solution consisting of about 10 to about 400 grams of an alkali metal hydroxide per liter of solution, wherein said solution comprises about 5% to about 30% by volume of a water soluble mono-, di-, or polyhydric alcohol, and about 70% to about 95% by volume of water, and rinsing said plastic in water prior to immersion in the catalyst solution.

* * * * *